US012557907B2

(12) United States Patent
Liu et al.

(10) Patent No.: US 12,557,907 B2
(45) Date of Patent: Feb. 24, 2026

(54) SHELVING UNITS UTILIZING HYBRID CONNECTION SYSTEM

(71) Applicants: Richard Liu, ChiaYi (TW); Gregory Mohr, Rolling Meadows, IL (US)

(72) Inventors: Richard Liu, ChiaYi (TW); Gregory Mohr, Rolling Meadows, IL (US)

(73) Assignee: Taiwan Shin Yeh Enterprise Co., Ltd., ChiaYi (TW)

( * ) Notice: Subject to any disclaimer, the term of this patent is extended or adjusted under 35 U.S.C. 154(b) by 253 days.

(21) Appl. No.: 18/212,769

(22) Filed: Jun. 22, 2023

(65) Prior Publication Data

US 2024/0423360 A1 Dec. 26, 2024

(51) Int. Cl.

| | |
|---|---|
| ***A47B 47/02*** | (2006.01) |
| ***A47B 47/00*** | (2006.01) |
| ***A47B 57/50*** | (2006.01) |
| *A47B 57/06* | (2006.01) |
| *A47B 57/18* | (2006.01) |
| *A47B 57/22* | (2006.01) |
| *A47B 57/44* | (2006.01) |

(52) U.S. Cl.

CPC ..... *A47B 47/028* (2013.01); *A47B 47/0058* (2013.01); *A47B 47/0083* (2013.01); *A47B 57/50* (2013.01); *A47B 47/00* (2013.01); *A47B 57/06* (2013.01); *A47B 57/18* (2013.01); *A47B 57/22* (2013.01); *A47B 57/44* (2013.01)

(58) Field of Classification Search

CPC ..... A47B 47/028; A47B 47/0058; A47B 47/0083; A47B 47/00; A47B 47/0041; A47B 47/02; A47B 47/021; A47B 47/027; A47B 57/06; A47B 57/08; A47B 57/10; A47B 57/16; A47B 57/20; A47B 57/18; A47B 57/22; A47B 57/30; A47B 57/32; A47B 57/34; A47B 57/44; A47B 57/48; A47B 57/50

See application file for complete search history.

(56) References Cited

U.S. PATENT DOCUMENTS

| | | | | | |
|---|---|---|---|---|---|
| 3,042,221 | A * | 7/1962 | Rasmussen | A47B 57/50 | 211/183 |
| 3,463,325 | A * | 8/1969 | Rogers | F16B 12/32 | 211/187 |
| 4,064,995 | A * | 12/1977 | Bustos | A47F 5/101 | 52/287.1 |
| 4,078,664 | A * | 3/1978 | McConnell | A47B 96/00 | 211/187 |
| 4,171,789 | A * | 10/1979 | Vander Hoek | A47B 57/42 | 108/108 |
| 4,955,490 | A * | 9/1990 | Schafer | A47B 96/02 | 211/187 |
| 5,011,031 | A * | 4/1991 | Konstant | A47B 47/027 | 211/192 |
| 5,012,938 | A * | 5/1991 | King | A47B 57/18 | 211/182 |

(Continued)

*Primary Examiner* — Devin K Barnett

(74) *Attorney, Agent, or Firm* — Michael P. Mazza; Michael P. Mazza, LLC

(57) ABSTRACT

A shelving assembly employing a hybrid connection system using both threaded and non-threaded fasteners, designed to provide shelving that is both relatively strong and durable, while also being capable of relatively rapid assembly and disassembly.

6 Claims, 22 Drawing Sheets

(56) References Cited

U.S. PATENT DOCUMENTS 5,463,966 A * 11/1995 Nilsson ..... F16B 12/34 108/193
5,749,481 A * 5/1998 Miller ..... A47B 47/021 211/187
5,845,795 A * 12/1998 Mulholland ..... A47B 47/027 248/221.12
6,230,910 B1 * 5/2001 Olsson ..... A47B 57/50 248/221.11
6,352,164 B1 * 3/2002 Hyatte ..... A47B 57/50 211/192
6,497,332 B1 * 12/2002 Konstant ..... A47B 47/027 211/189
7,252,202 B2 * 8/2007 Saltzberg ..... A47B 57/50 211/187
7,748,546 B2 * 7/2010 Konstant ..... A47B 47/021 52/693
7,857,152 B2 * 12/2010 Smith ..... A47B 96/00 211/187
8,632,272 B2 * 1/2014 Wojtowicz ..... A47F 5/14 312/265.4
8,695,816 B2 * 4/2014 Troyner ..... A47B 96/1441 211/187
9,215,926 B1 * 12/2015 Offerman ..... A47B 47/02
9,215,931 B1 * 12/2015 Offerman ..... A47B 96/024
9,290,322 B2 * 3/2016 Heijmink ..... A47B 47/0058
D777,480 S * 1/2017 Anderson ..... D6/675.2
9,723,925 B1 * 8/2017 Tsai ..... A47B 45/00
9,961,995 B2 * 5/2018 Kam ..... A47B 47/028
10,299,594 B2 * 5/2019 Liss ..... A47B 47/027
10,376,047 B1 * 8/2019 Ebbesson ..... A47B 47/0083
10,806,257 B1 * 10/2020 Liu ..... A47B 47/024
11,039,686 B2 * 6/2021 Min ..... A47B 47/0083
11,390,460 B2 * 7/2022 Iellimo ..... A47B 96/021
11,602,221 B1 * 3/2023 Beck ..... A47B 47/0083
11,647,833 B2 * 5/2023 Hanlon ..... A47B 47/028 211/192
11,992,120 B2 * 5/2024 Davis ..... A47B 57/34
12,220,056 B2 * 2/2025 Liu ..... A47B 96/06
12,268,298 B2 * 4/2025 Hanlon ..... A47B 47/027
12,310,495 B2 * 5/2025 Chakraborthy .... A47B 47/0083
2006/0163185 A1 * 7/2006 Konstant ..... A47F 5/01 211/189
2007/0175846 A1 * 8/2007 Konstant ..... A47B 47/021 211/189
2012/0000871 A1 * 1/2012 Troyner ..... A47B 47/021 211/134
2012/0067838 A1 * 3/2012 Lawson ..... A47B 47/024 211/183
2014/0116973 A1 * 5/2014 Buckley ..... A47F 5/00 29/525.01
2015/0090683 A1 * 4/2015 Sabounjian ..... A47B 96/14 211/186
2015/0282613 A1 * 10/2015 Chen ..... A47B 96/021 211/187
2017/0280875 A1 * 10/2017 Buckley ..... A47B 57/34
2017/0347793 A1 * 12/2017 Wang ..... A47B 57/22
2018/0237183 A1 * 8/2018 McGhee, III ..... A47B 47/028
2019/0290000 A1 * 9/2019 Davis ..... A47F 5/13
2019/0328134 A1 * 10/2019 Walker ..... A47B 96/1408
2021/0030149 A1 * 2/2021 Carrasco López .... A47B 57/34
2021/0186210 A1 6/2021 Bohr
2022/0378195 A1 12/2022 Chen
2022/0378197 A1 12/2022 Chen

* cited by examiner

SHELVING UNITS UTILIZING HYBRID CONNECTION SYSTEM

BACKGROUND OF THE INVENTION

The present invention generally relates to shelving units capable of rapid assembly and disassembly, and more particularly to durable and sturdy shelving units with "hybrid" connections, using various fastener types.

U.S. Pat. No. 10,806,257 for "Wire Shelving Assembly" assigned to Taiwan Shen Yeh Enterprise Co., Ltd., is hereby incorporated by reference in its entirety herein.

Threaded fasteners, including bolts, nuts and screws, are used to durably fasten various items, including shelving units. While such fasteners have strength and durability advantages, they are also time-consuming to employ, and may require special assembly tools such as screwdrivers, wrenches, etc. Other fastener types, such as "male" features like punched, cut or stamped rivets or tabs, which may be fit into "female" features such as holes like slots or keyholes, or similar receptacles, allow more rapid, and manual, assembly, without requiring the use of special tools, but are not as strong or durable as using threaded fasteners.

The present invention employs a novel mixture of "hybrid" fastener types (i.e., threaded fasteners, and non-threaded fasteners) to enable the provision of relatively strong, durable shelving units, which may still be fairly rapidly assembled.

Accordingly, there is a need for shelving units which overcomes some of the disadvantages of using only threaded fasteners (more assembly and disassembly time required, and requiring the use of special tools) while still retaining some of the advantages of threaded fasteners (strength, durability), and while obtaining some of the advantages of non-threaded fasteners (more rapid assembly and disassembly time).

Definition of Claim Terms

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

"Hybrid" fastener types means using both threaded and non-threaded fasteners.

"Relatively rapidly assembled" means that a shelving rack is assembled using hybrid fastener types, where the use of non-threaded fasteners is primarily used for assembling the individual shelves, and threaded fasteners are primarily used for assembling the main frame and side frames, "Snap-fit" means allowing a coupling connection without the use of threaded fasteners and without requiring the use of special tools, but rather allowing coupling connection solely through the use of manually-applied force, and encompasses the use of "male" fastener types such as punched, cut or stamped rivets, nubs or tabs, coupled together with "female" fastener types with holes or indentations, including slots, holes such as but not limited to keyholes, or similar types of receptacles.

SUMMARY OF THE INVENTION

The objects mentioned above, as well as other objects, are solved by the present invention, which overcomes disadvantages of prior shelving units, while providing new advantages not previously associated with them. This summary is provided to introduce a selection of concepts in a simplified form that are further described below in the Detailed Description, so that the claimed invention may be better understood. However, this summary is not intended to limit the scope of the claimed subject matter.

Generally in accordance with the present invention, shelving racks are assembled using a hybrid fastening system in which the outer frame is generally secured using threaded fasteners at all four corners at the top and bottom of the frame, while non-threaded fasteners are generally used for assembly of the intermediate, interior portions of the shelving unit. Additionally, various special fastening types may be used, as discussed below. Using this hybrid fastening system, each of the shelving assembly examples described below may be relatively rapidly assembled.

In one preferred shelving assembly example of the present invention, the shelving assembly is provided with first and second side frame structures, each including a pair of adjacent vertical posts connected by three or more horizontal members. The first and second side frame structures may be connected to each other by three or more pairs of cross-members, including top-most and bottom-most pairs of cross-members, and one or more intermediate pairs of cross-members. Top-most and bottom-most horizontal members may be welded to the vertical posts. One or more shelving units may be located intermediate between the top-most and bottom-most horizontal members. The one or more shelving units may be connected by snap-fit attachment to the vertical posts. The top-most and bottom-most cross-members may be attached by threadable fasteners to the vertical posts.

With the above-referenced shelving assembly example, for further stability a tube member may be weldably and diagonally connected to a pair of the adjacent vertical posts. Also, the cross-members may have a flanged end with punched square apertures, and ends of the vertical posts may also include punched square apertures, with each of the punched square apertures accommodating bolts with square necks. The bolts may be sized to mate with thumb nuts having serrated edges. The ends of the shelving units may include stamped rivets or tabs for accommodating apertures on the vertical posts. Keyholes may be stamped into substantially an entire length of the vertical posts. The vertical posts may be C-shaped in cross-section, with an end of the C-shaped of each of the C-shaped vertical posts including side-by-side keyholes that run substantially an entire length of the vertical posts, and a side of each of the C-shaped vertical posts, at opposing ends of the posts, preferably including stamped square apertures.

Concealed Post Shelving Assembly

In a second example of the shelving assembly of the present invention, first and second side frame structures are provided, with each including a pair of adjacent vertical posts connected by pairs of three or more opposing horizontal members, including a pair of top-most opposing horizontal members and a pair of bottom-most opposing horizontal members. The first and second side frame structures may be connected to each other by three or more pairs of cross-members, including top-most, at least one intermediate, and bottom-most, pairs of cross-members. The pair of top-most opposing horizontal members and the pair of bottom-most opposing horizontal members may each be connected by threadable fasteners to the vertical posts.

In the immediately above-referenced shelving assembly example, one or more shelving units may be located intermediately between the pair of top-most opposing cross-members and the pair of bottom-most opposing cross-members. The one or more shelving units may be connected by snap-fit attachment to the vertical posts. The pair of top-most opposing cross-members and the pair of bottom-most opposing cross-members may be attached by threadable fasteners to the vertical posts. Also, preferably, the pair of top-most opposing cross-members and the pair of bottom-most opposing cross-members each have ends with punched square apertures, for accommodating bolts with square necks that also connect with punched square apertures located at ends of the vertical posts. The bolts may be sized to mate with thumb nuts having serrated edges. Ends of the shelving units may include stamped rivets or tabs for accommodating apertures on the vertical posts. Keyholes made be provided and stamped into substantially an entire length of the vertical posts. The vertical posts may be C-shaped in cross-section, with an end of the C-shape of each of the C-shaped vertical posts including side-by-side keyholes that run substantially an entire length of the vertical posts, and with a side of the C-shape of each of the C-shaped vertical posts, at opposing vertical ends of the posts, including stamped square apertures. The keyholes may be stamped into but not through interior sides of the vertical posts, such that the keyholes for posts adjacent an observer in front of the shelving assembly are concealed, or at least partially concealed, from the observer's view.

"L"-Shaped Corner Post Shelving Assembly

In yet another example of the present invention, a shelving assembly is provided with first and second side frame structures, with each side frame structure including a pair of adjacent vertical posts connected by pairs of three or more opposing horizontal members, including a pair of top-most opposing horizontal members, at least one pair of intermediate horizontal members, and a pair of bottom-most opposing horizontal members. The first and second side frame structures may be connected to each other using three or more pairs of cross-members, including top-most, intermediate, and bottom-most, pairs of cross-members. The pair of top-most opposing horizontal members and the pair of bottom-most opposing horizontal members may each be connected by threaded fasteners to the vertical posts. One or more shelving units may be located at an intermediate position between the pair of top-most opposing cross-members and the pair of bottom-most opposing cross-members. The one or more shelving units may be connected by snap-fit attachment to the vertical posts. The pair of top-most opposing cross-members and the pair of bottom-most opposing cross-members may be attached by threaded fasteners to the vertical posts.

With the immediately above-referenced shelving assembly example, adjacent vertical posts may be vertically stacked, and connected using a vertical pin. With this example, ends of the shelving units may include stamped rivets or tabs for accommodating apertures stamped on the vertical posts. The apertures stamped on the vertical posts may include keyholes stamped into substantially an entire length of the vertical posts. The vertical posts may be L-shaped in cross-section, and each of the two sides of the L-shaped vertical posts may include a series of stamped keyholes running substantially an entire length of the vertical posts.

Side-by-Side Shelving Racks

In still another example of the shelving assembly of the present invention, a first shelving rack may include two pairs of vertical posts, and cross-members and horizontal members connecting these two pairs of vertical posts to each other. A second shelving rack may include two pairs of vertical posts, and cross-members and horizontal members connecting these two pairs of vertical posts to each other. The second shelving rack may be located side-by-side to the first shelving rack, and a removably attachable connector may be provided for attaching the first and second shelving racks to each other in a side-by-side position.

Heavy Duty Shelving Assembly

In still another shelving assembly example of the present invention, first and second side frame structures are provided, with each side frame structure including a pair of adjacent vertical posts connected by pairs of three or more opposing horizontal members, including a pair of top-most opposing horizontal members, at least one pair of intermediate horizontal members, and a pair of bottom-most opposing horizontal members. The first and second side frame structures may be connected to each other by three or more pairs of cross-members, including at least top-most and bottom-most pairs of cross-members. The vertical posts may be C-shaped in cross-section, with one end of the C-shape including side-by-side keyholes located serially along substantially an entire length of the vertical posts, and at least one side of the C-shape, at opposing ends of the posts, including stamped apertures. The pair of top-most opposing horizontal members and the pair of bottom-most opposing horizontal members may each be weldably connected to the vertical posts. One or more shelving units may be located at an intermediate position between the pair of top-most opposing cross-members and the pair of bottom-most opposing cross-members. The one or more shelving units may be connected by snap-fit attachment to the vertical posts. The pair of top-most opposing cross-members and the pair of bottom-most opposing cross-members may be attached by threaded fasteners to the vertical posts. Horizontal members may be located at an intermediate position between the top-most and bottom-most horizontal members, and may be connected to the vertical posts using thumbscrews mating with flange nuts. The flange nuts may be inverted flange nuts with a hexagon-shaped inversion, and the intermediate horizontal members may have hexagon-shaped cutouts sized to mate with the inversion of the flange nuts.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

FIG. 113 is a perspective view of a bolt which may be used for fastening the side members and cross-members to the vertical corner posts, concerning the FIG. 2-type shelving system;

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figure 6:
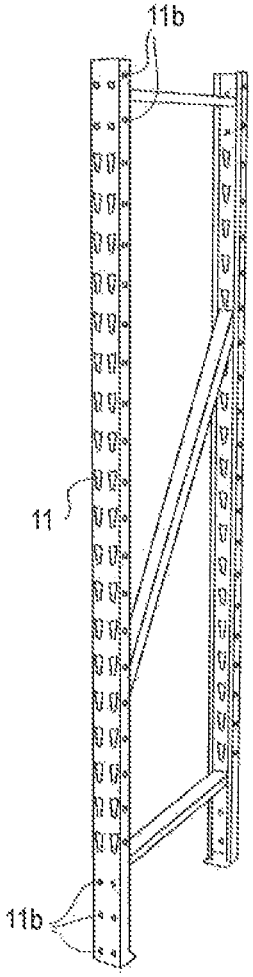
FIG. 6 is a side and front perspective view of a side frame structure used with the industrial rack shelving system of FIG. 1.
Figure 7:
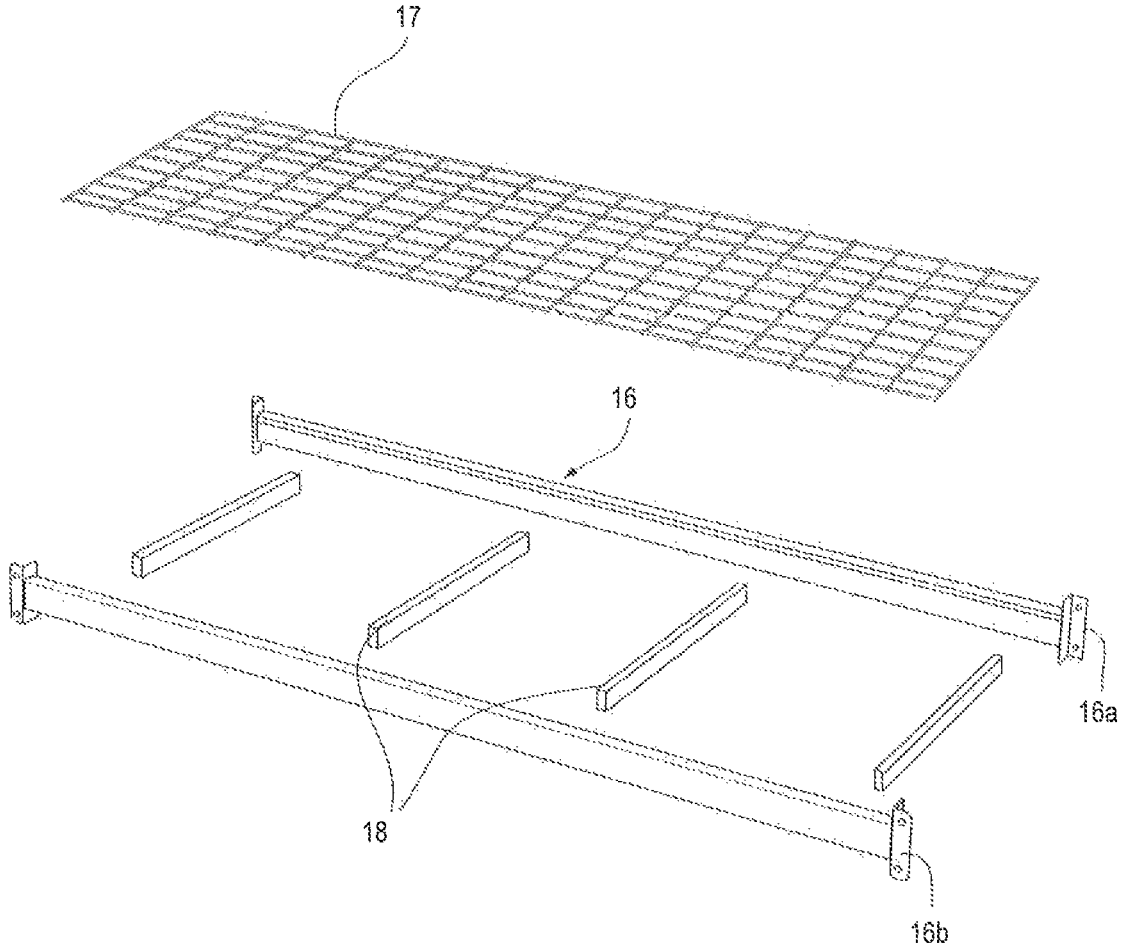
FIG. 7 is a planar parts perspective view of an individual shelf which may be used with the industrial rack shelving system of FIG. 1.

Various preferred embodiments of shelving units of the present invention are shown here in order to illustrate different aspects of the present invention, including: industrial shelving rack 10 (FIGS. 1 and 5-7); concealed post shelving rack 20 (FIGS. 2, 9A-9B, 10A-10C and 11A-11B); "L" shaped corner post shelving rack 30 (FIGS. 3, 12A-12B, 13A-13F and 14; and heavy-duty shelving rack 40 (FIGS. 4, 15, 16A-16B, 17-18 and 19A-19B), Referring first to industrial shelving assembly 10 of FIGS. 1 and 5-7, industrial shelving rack 10 includes, for example: four "C"-shaped vertical posts 11 with punched keyholes 11*a* located on the middle edge (FIG. 6) and running the full length of each post 11, and square punched holes 11*b* located at the top and bottom ends of each post 11, on each side of opposing sides of the C-shaped channel; four top and bottom cross members 12, with end flanges 12*a* mounting apertures 12*a*'; four horizontal tubes 13, each of which may be welded to two adjacent vertical posts 1 as shown, and two diagonal members 15 are attached by welding to two adjacent vertical posts 11.

Each adjacent pair of vertical posts 11, together with welded horizontal tubes 13 and diagonal member 15, forms a separate side frame structure 14. Each side frame structure 14 may be attached to the four top-most and bottom-most cross-members using threaded fasteners.

Figure 8A:
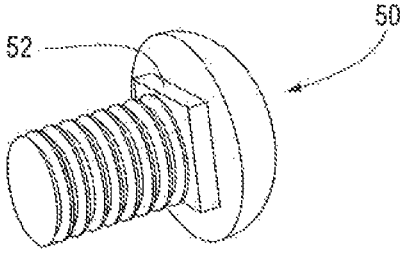
FIG. 8*a* is a perspective view of a bolt which may be used with the shelving systems of the present invention.
Figure 8B:
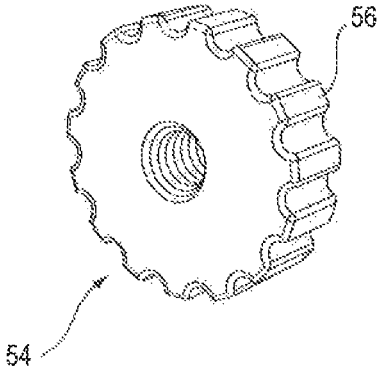
FIGS. 8*b* and 8*c* are front and rear perspective views of a thumb nut with serrated edges which may be used to mate with the bolt of FIG. 8*a* for use in attachment of the shelving systems of the present invention.
Figure 8C:
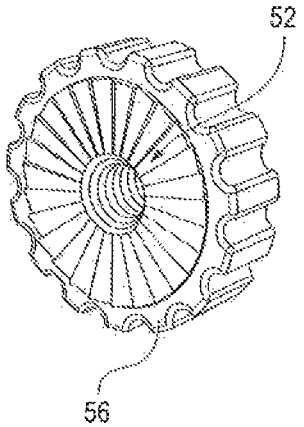

Preferably, the threaded fasteners employed are bolts and thumb nuts with serrated edges. Bolts 50 with square necks 52 (FIG. 8A) are preferred, as they will fit into square apertures 12*a* on cross members 12, to prevent the bolts from rotating during assembly or use. Serrated edges 56 of thumb nuts 54 (FIGS. 8B-8C) offer enhanced manual purchase to facilitate tightening.

Shelves 16 (FIG. 7) may be located at intermediate locations between the top-most and bottom-most cross-members 12. Shelves 16 may include, e.g., wire racks 17, cross members 18, and end flanges 16*a* mounting rivets 16*a*'. Shelves 16 may be rapidly attached by moving rivets 16*a*' into keyholes 11*a* on vertical posts 11, and pushing down on the shelving, causing the rivets 16*a*' to move down in the keyhole from the wider portion of the keyhole to the narrower portion, wherein the shelving is fixed into position. Consumers have the choice of adding additional, adjustable-height shelves using the rivet/keyhole attachment based on individual needs and usage preferences, as keyholes are preferably located along substantially the entire length of the posts, other than the top-most and bottom-most locations of the posts (to more easily accommodate the square cutouts on cross-members 12 for connection to the posts using the threaded fasteners), It will now be understood that threaded fasteners are integral to the assembly here, as without their use as indicated, the shelving units disclosed here will collapse. However, because each side frame structure may already be integrally formed (due to the welded horizontal tubes 13 and the welded diagonal members 15), once the top-most and bottom-most cross-members 12 are attached to the posts using threaded fasteners, the shelves may be rapidly manually assembled without the use of special tools, by simply pushing shelve rivets 16*a* into the corresponding keyholes on vertical posts 11 (tabs and slots may alternatively be used). This hybrid connection system provides more rapid assembly than if only threaded fasteners were used, while also providing enhanced strength and durability as compared to shelving systems using only non-threaded fasteners.

Referring now to FIGS. 2, 9A-9B, 10A-10C and 11A-11B, an alternative embodiment of the present invention, concealed post shelving assembly 20, is shown, and includes: four L-shaped vertical posts 22 with punched keyholes 22*a* located on one of the two sides of the L-shape and running the full length of each post 22, and square punched holes 22*b* located at the top and bottom of each post 22, and on each of the two sides of the L-shape; four top and bottom cross members 24 with square apertures 24*a* located at opposing ends of each cross member 24, for connection using threaded fasteners to post holes 22*h*; and four horizontal tubes 23, with apertures 23*a*, each of which connect using threaded fasteners to post holes 22*b* of two adjacent vertical posts 22.

Figure 1:
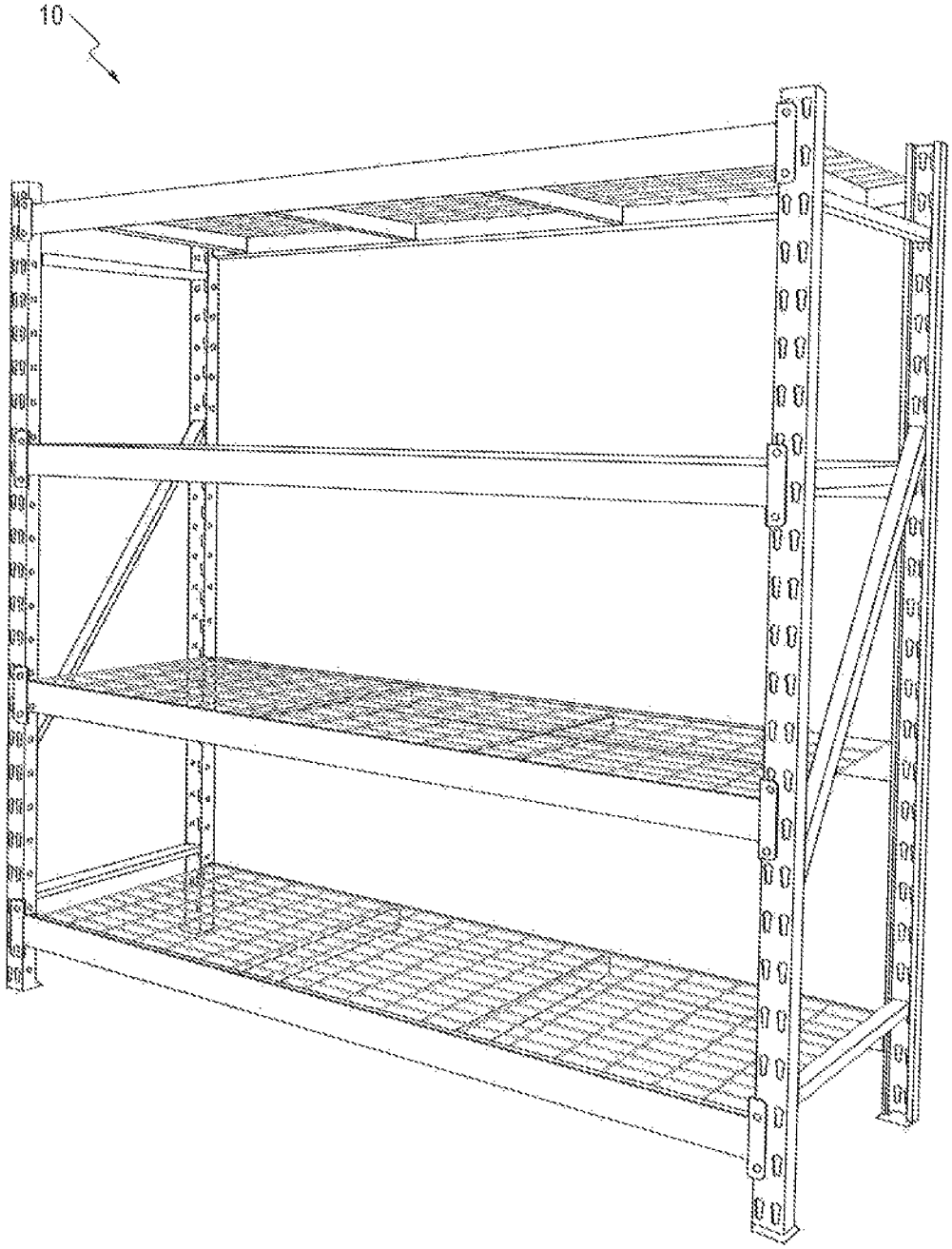
FIG. 1 is a front and side perspective view of one preferred embodiment of the shelving system of the present invention, referred to here as an "industrial rack" shelving system.
Figure 2:
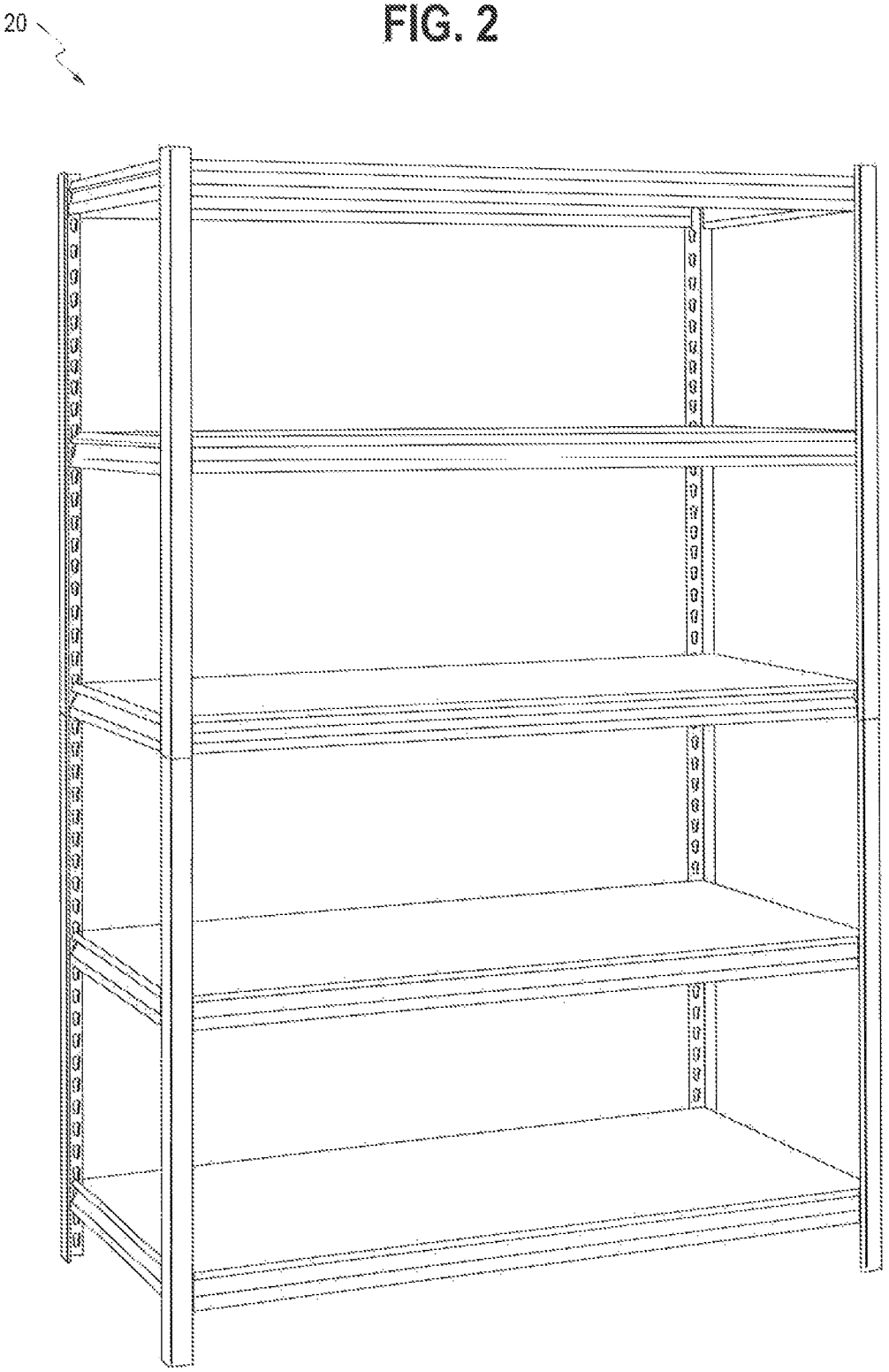
FIG. 2 is a front and side perspective view of another preferred embodiment of the shelving system of the present invention, referred to here as a "concealed post rack" shelving system.
Figure 3:
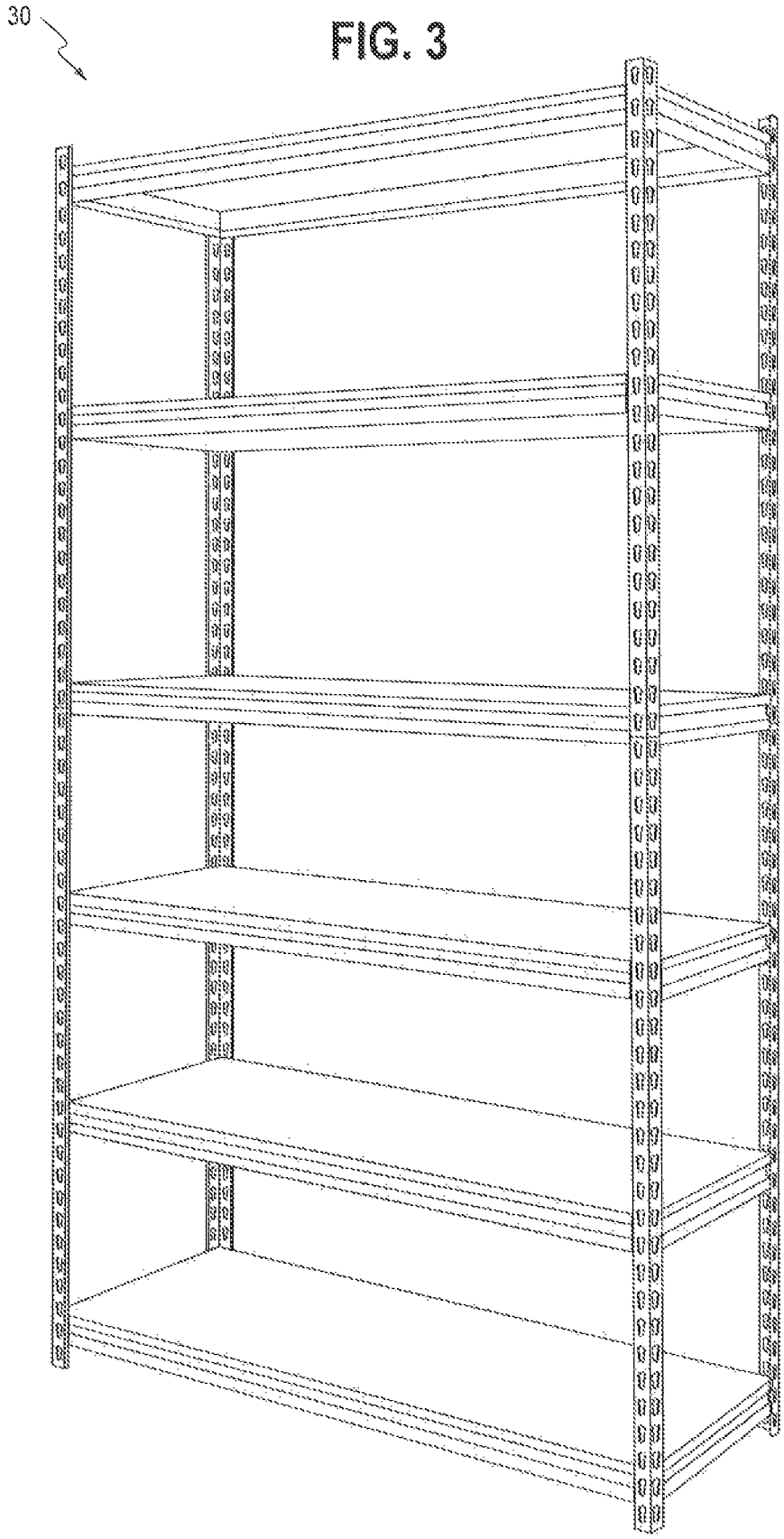
FIG. 3 is a front and side perspective view of another preferred embodiment of the shelving system of the present invention, referred to here as a "L-shape corner post rack" shelving system.
Figure 4:
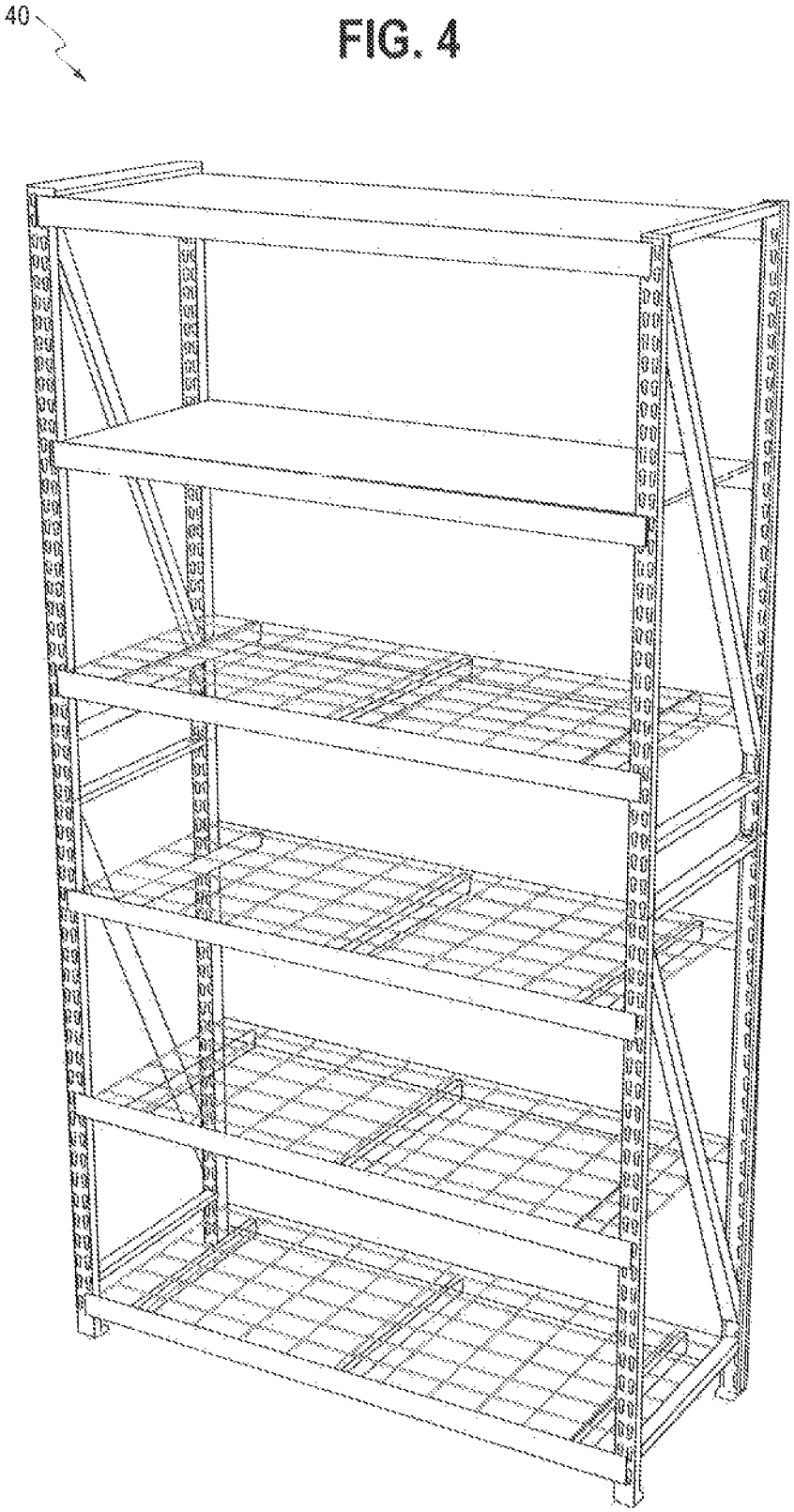
FIG. 4 is a front and side perspective view of another preferred embodiment of the shelving system of the present invention, referred to here as a "heavy duty rack" shelving system.
Figure 5:
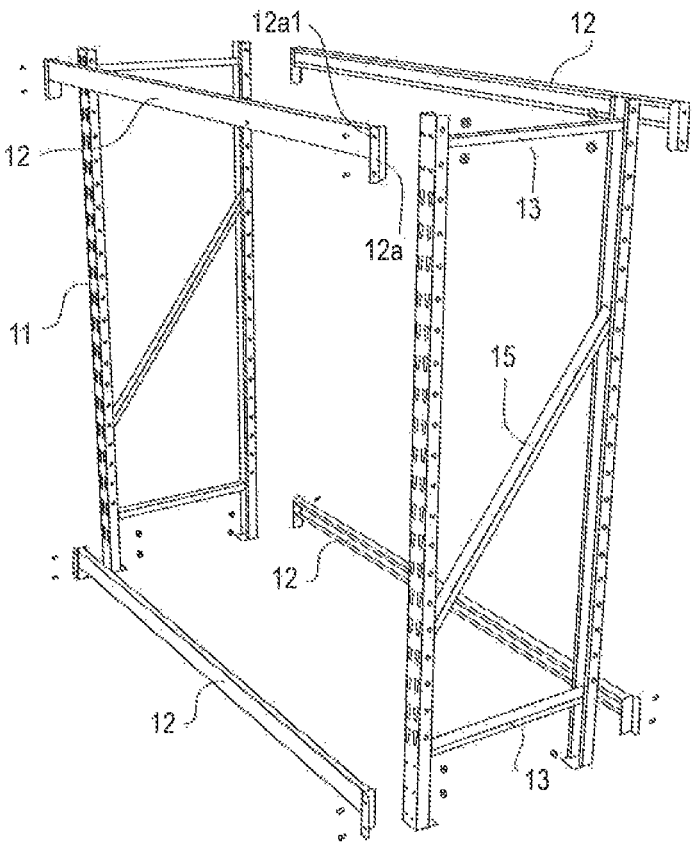
FIG. 5 is a side and front perspective parts view of a frame for the industrial rack shelving system of FIG. 1.

As shown in FIG. 2, keyholes 22 are concealed from exterior view due to the fact that the keyholes are located on the inside edges of vertical posts 22, and they are stamped only through an interior surface of the post, and not through the entire side of the post, as shown.

Two adjacent vertical posts 22, and two bottom-most and top-most corresponding horizontal tubes 23, threadably fastened to the posts, form a side frame structure 25.

Again, where threaded fasteners are called for above, bolts 50 with square necks 52 may be used, and may mate with thumb nuts 54 with serrated edges 56.

Figure 10A:
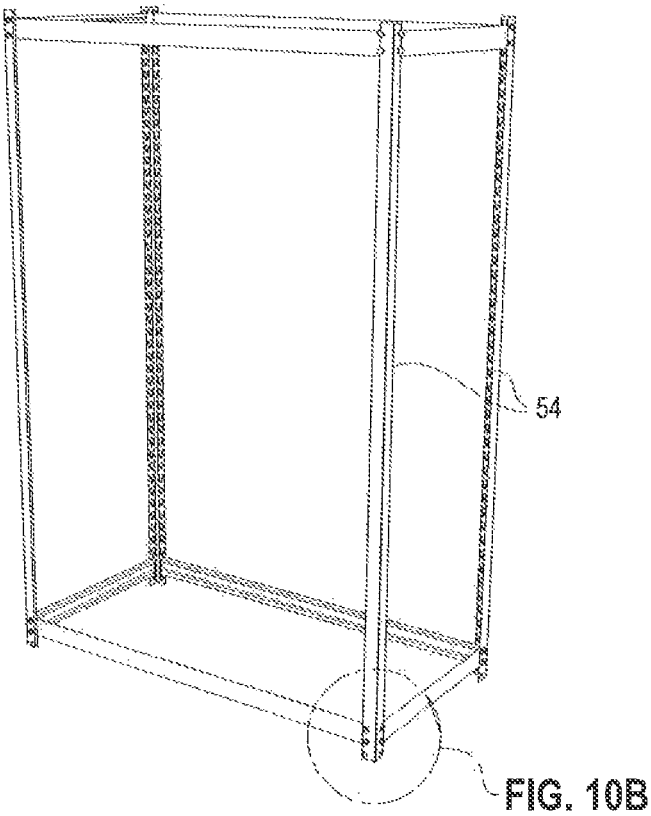
FIG. 10A is a front and side perspective view of the attached frame which may be used with the "concealed post rack" shelving system of FIG. 2.
Figure 10B:
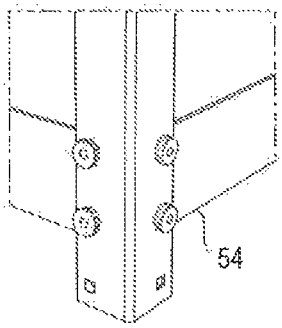
FIG. 10B is an enlarged partial perspective view of the lower portion of a vertical corner post attached to a side member and a cross-member, concerning the "concealed post rack" shelving system of FIG. 2.
Figure 10C:
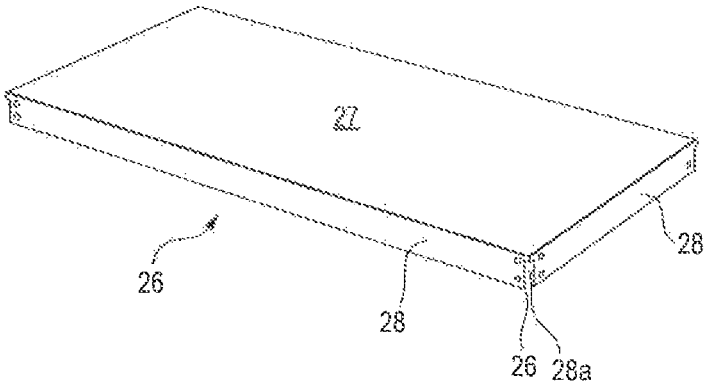
FIG. 10C is a "pan"-type shelf which may be used with the FIG. 2-type shelving system.

Shelves 26 (FIG. 10C) may be located intermediate of the top-most and bottom-most cross-members 24. Shelves 26 may be pan-shaped, as shown, or alternatively employ wire racks as with shelves 16. Shelves 26 again may be rapidly attached to the posts, as shelves 26 may include rivets 26*a* for coupling to keyholes 22*a* on vertical posts 22, as shown in FIG. 10C. Shelf 26 may include floor 27 and downwardly extending sides 28, with corner cutouts 28*a* for accommodating post 22.

Referring now to FIGS. 3, 12A-12B, 13A-13F and 14, yet another embodiment of the present invention, "L"-shaped corner post shelving assembly 30, is shown, and includes: four L-shaped vertical posts 32 with punched keyholes 32*a* running the full length of each of two L-shaped sides of each post 32, and square punched holes 32*b* located at the top and bottom of each of the two L-shaped sides of post 32; four top and bottom cross members 34 with square apertures 34*a* located at opposing ends of each cross member 34; and four horizontal tubes 33 with end apertures 33*a* for connection using threaded fasteners to apertures 32*a* on one side of L-shaped post 32.

Figure 11A:
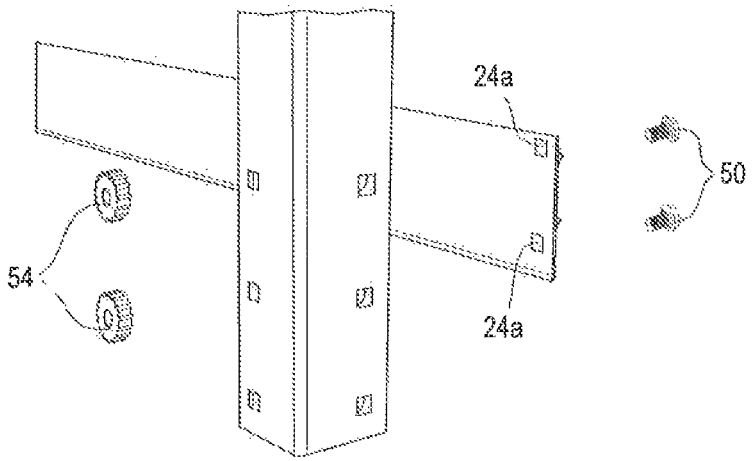
FIG. 11A is an enlarge partial perspective view of a vertical corner post, prior to attachment to a side member and a cross-member, concerning the "concealed post rack" shelving system of FIG. 2.
Figure 11B:
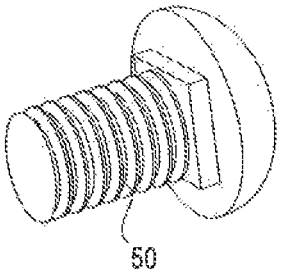
Figure 12A:
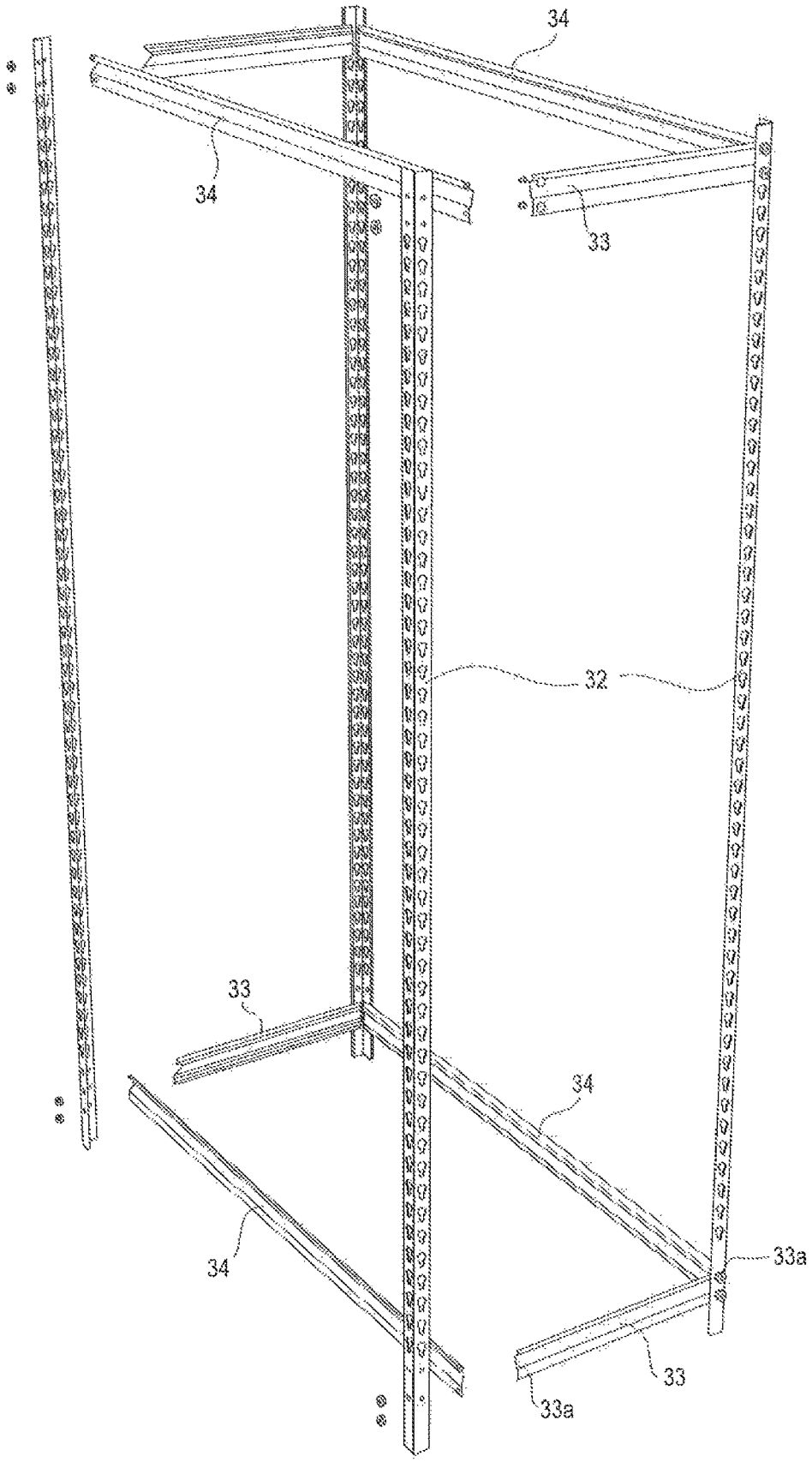
FIG. 12A is a side and front perspective parts view of a frame for the "L-shape corner post rack" shelving system of FIG. 3.
Figure 12B:
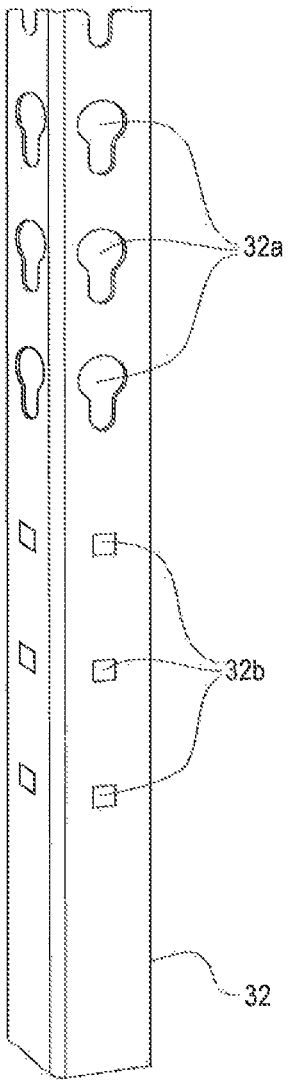
FIG. 12B is an enlarge partial perspective view of a lower or upper portion of a vertical corner post which may be used for the "L-shape corner post rack" shelving system of FIG. 3.
Figure 13A:
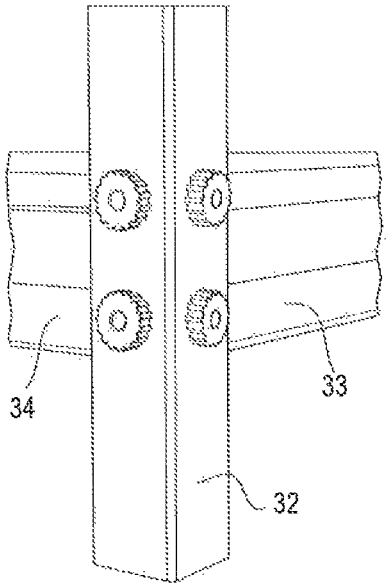
FIGS. 13A and 13B are enlarged partial perspective views showing side members and cross-members attached (FIG. 13A) and unattached (FIG. 13B) to an L-shaped vertical corner post, in connection with the "L-shape corner post rack" shelving system of FIG. 3.
Figure 13B:
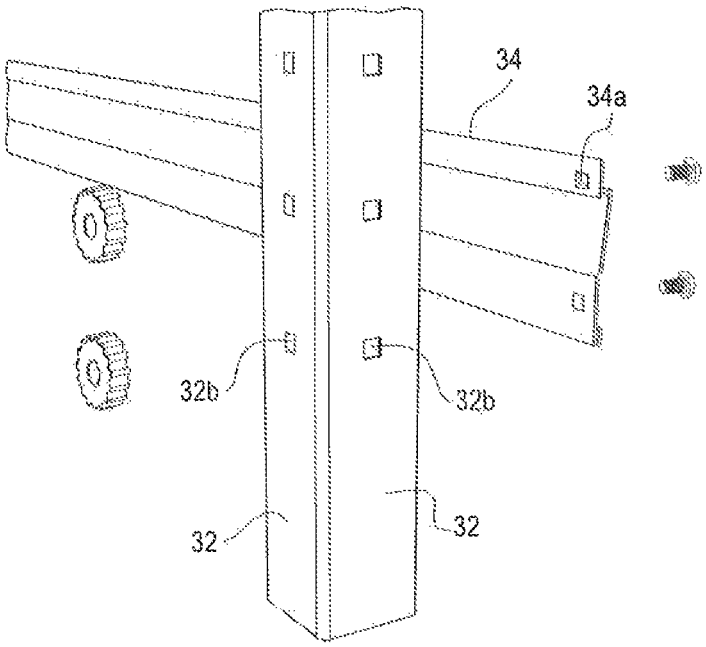
Figure 13C:
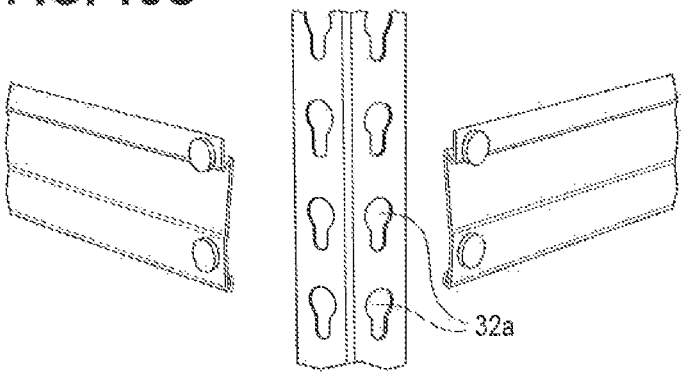
FIG. 13C is an enlarged partial perspective view showing how rivets located at ends of intermediate side members and cross-members may be attached to adjacent keyholes located at intermediate locations on an L-shaped vertical corner post.
Figure 13D:
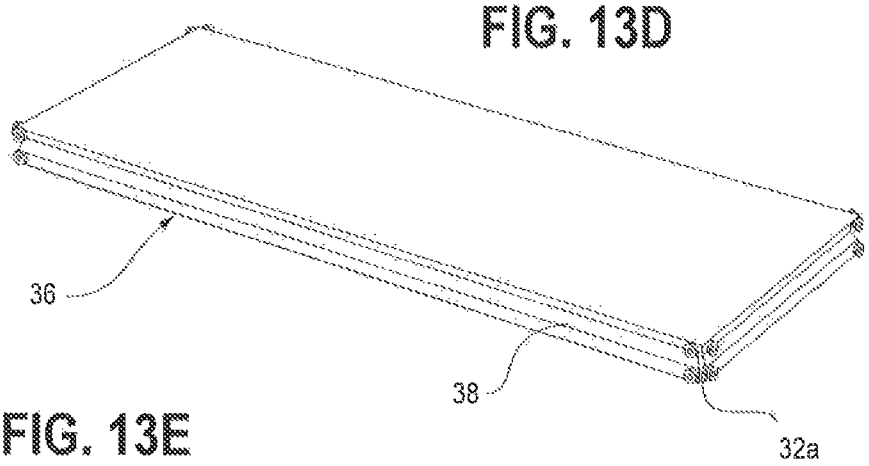
FIG. 13D is a planar perspective view of an individual shelf which may be used in connection with the "L-shape corner post rack" shelving system of FIG. 3.
Figure 13E:
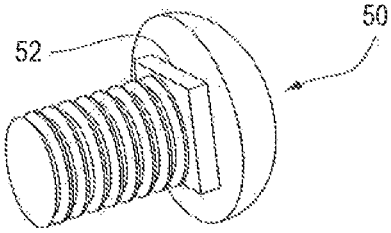
FIG. 13E is a perspective view of a bolt which may be used in connection with the FIG. 3-type shelving system.
Figure 13F:
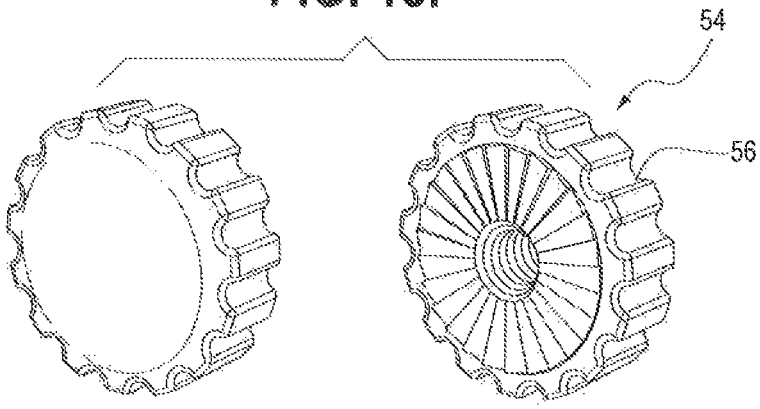
FIG. 13F shows rear and front perspective views of a thumb nut with serrated edges which may be used in connection with the FIG. 3-type shelving system.
Figure 14:
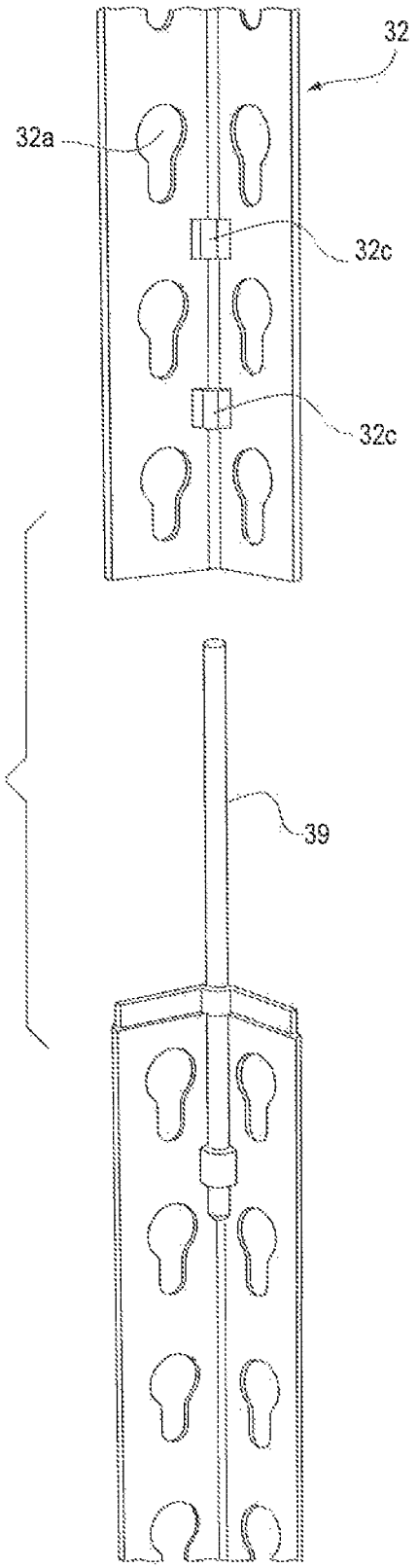
FIG. 14 is an enlarged partial perspective view of an intermediate inner portion of two vertically-stacked generally L-shaped vertical corner posts attached by a vertical pin, which may be used in connection with the FIG. 3-type shelving system.
Figure 15:
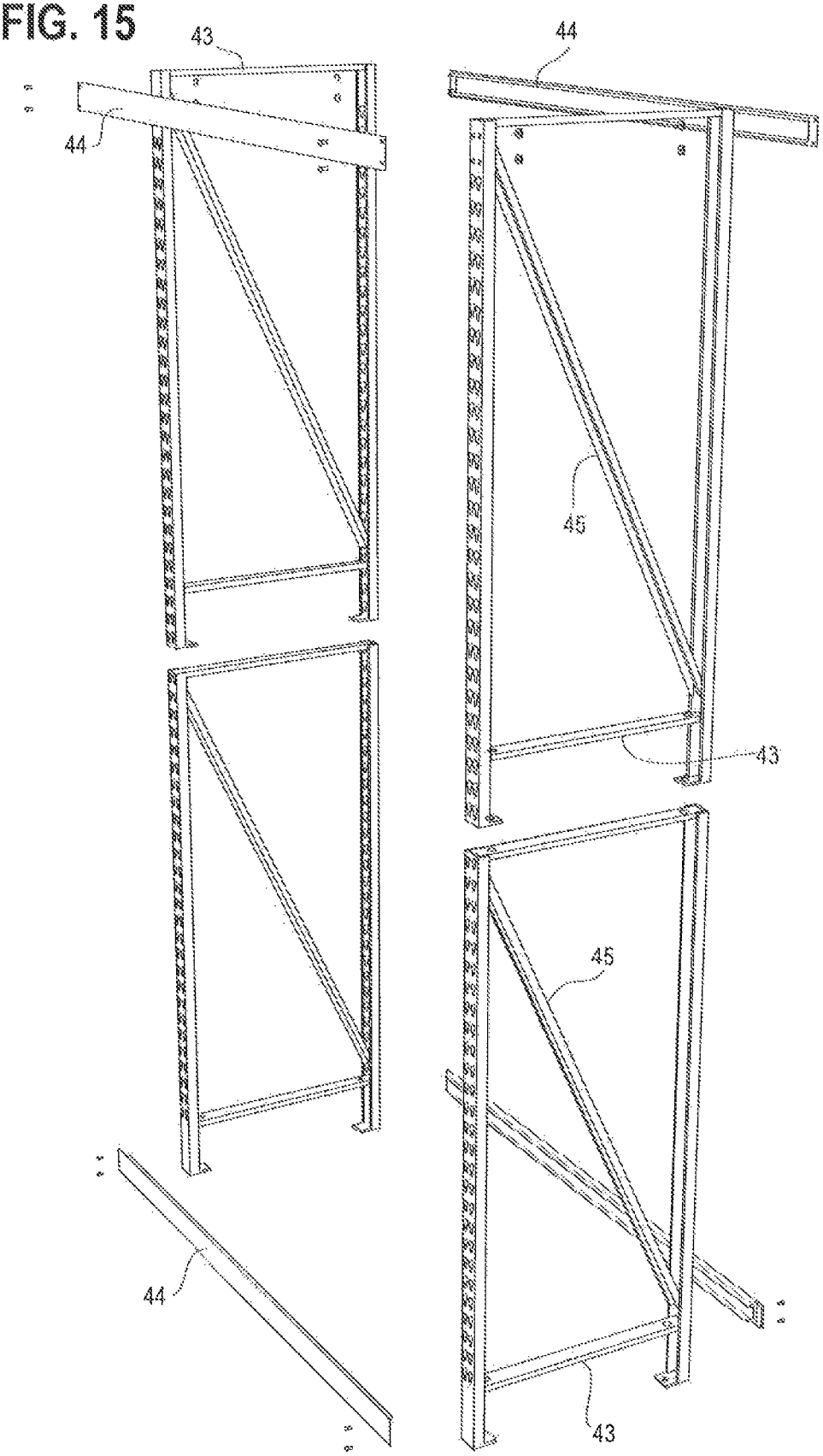
FIG. 15 is a side and front parts perspective view showing an unattached frame of the "heavy duty rack" shelving system of FIG. 4.
Figure 16A:
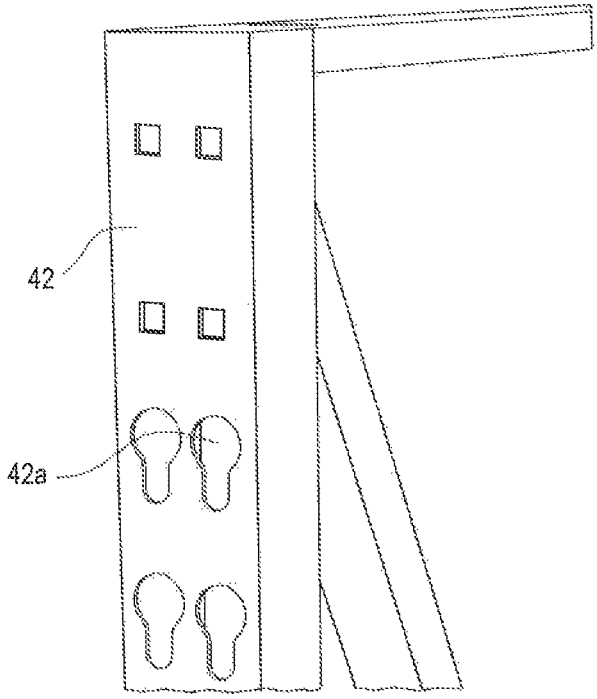
FIGS. 16A and 16B are enlarged partial perspective views of top and bottom portions of a vertical corner post, respectively, each showing an attached side member, and the top view showing a diagonal member as well, in connection with the FIG. 4-type shelving system.
Figure 16B:
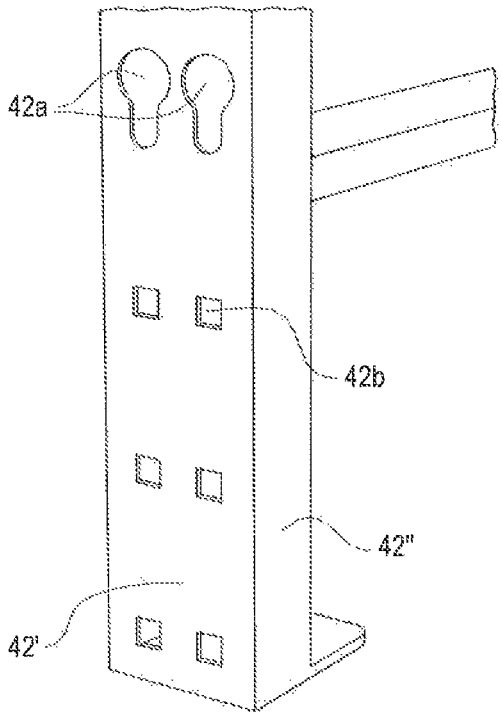

Again, where threaded fasteners are called for above, and referring to FIGS. 11A and 11B, bolts 50 with square necks 52 may be used, and mated with thumb nuts 54 with serrated edges 56.

Shelves 36 may again be located intermediate of the top-most and bottom-most cross-members 34. Shelves 36 may be rapidly attached to posts 32 using the rivet/keyhole connection, or a slot/tab connection. Shelf 36 may include floor 37 and downwardly extending sides 38, with corner spaces 38*a* for accommodating post 32.

With this example, and for the shelving rack examples that utilize an L-shaped vertical post (FIGS. 2 and 3), a pin 39 may be slid into correspondingly-sized brackets 32*c* which may be located on the inside corner of L-shaped post 32, to hold two adjacent vertical posts in vertical position; this allows the shelving height to be increased, as desirable, Pin 39 may be of sufficient length, thickness and material selection to provide the vertical posts that it supports with sufficient strength and durability, as will be understood by those of skill in the art.

Figure 9A:
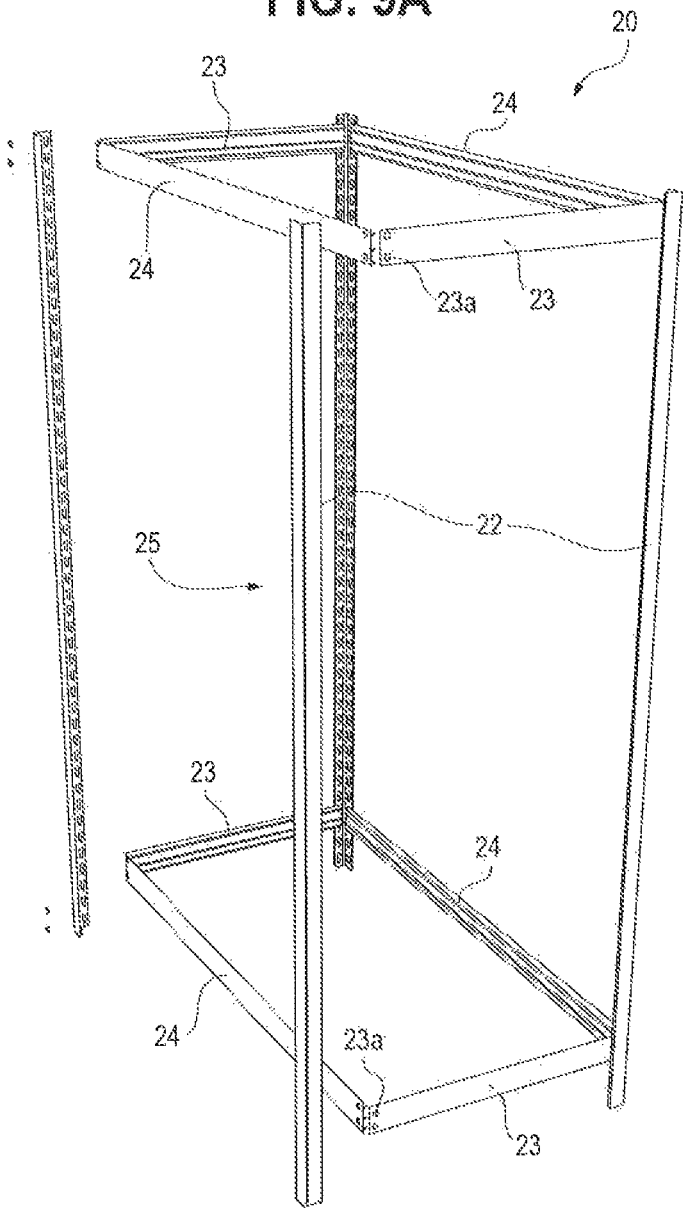
FIG. 9A is a side and front perspective parts view of a frame for the "concealed post rack" shelving system of FIG. 2.
Figure 9B:
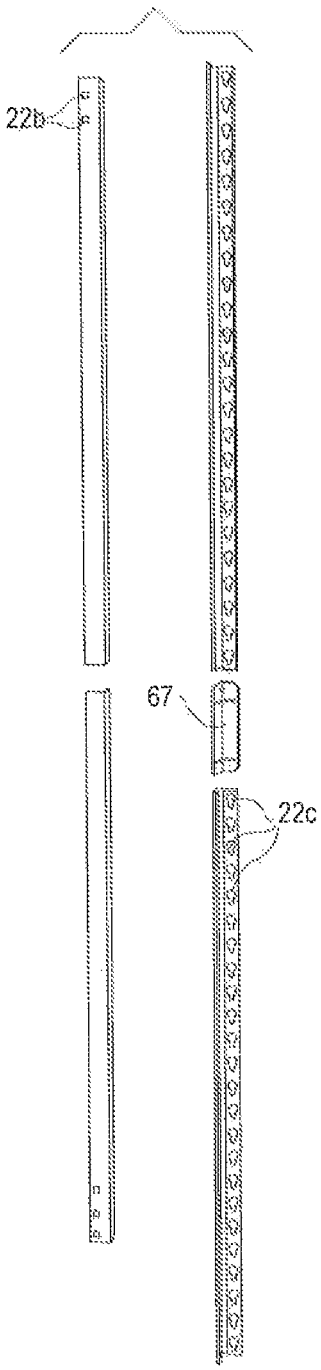
FIG. 9B shows rear and front perspective views, respectively, of the L-shaped corner posts which may be used with the "concealed post rack" shelving system of FIG. 2.
Figure 9C:
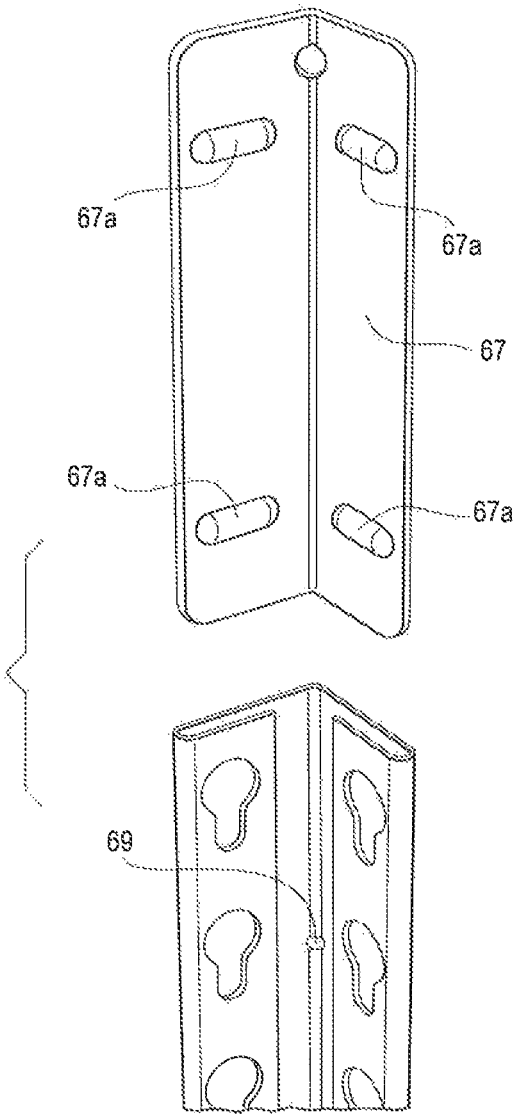
FIG. 9C is an enlarged planar perspective view of a coupler located above the end of a vertical post.

Alternatively, with the FIG. 2-type shelving assembly example, a separate coupler 67 may employed, as shown in FIG. 9B, having stamped protrusions 67*a* on the inside surface of the coupler that frictionally engage with the inside surfaces of the adjacent vertical post ends to provide a snug fit with the post and hold the coupler in place. Near the end of each vertical post is a stop 69 engaging the end of the coupler, to hold the coupler in position.

Finally, referring to FIGS. 4, 15, 16A-163, 17-18 and 19A-19B, still another embodiment of the present invention, heavy duty shelving assembly 40, is shown, and includes: four generally C-shaped vertical posts 42 with punched keyholes 42*a* running the full length of each post 42, with two side-by-side keyholes located on the main side 42', and square punched holes 42*b* located at the top and bottom of each of posts 32, on the main side 42'; four top and bottom cross members 44 with square apertures 34*a* threadably fastened to posts 42 at opposing ends of each cross member 44; four horizontal tubes 43, each tube 43 welded at an end to a vertical post 42 as shown; and four diagonal members 45, each welded to an inside edge of post 42 as shown.

An adjacent pair of vertical posts 42, together with top-most and bottom-most welded horizontal tubes 43, and a pair of welded diagonal tubes 45, form a sturdy side frame structure 46. Each side frame structure may be connected via threaded fasteners to a pair of top-most, and a pair of bottom-most, cross members 44.

Again, where threaded fasteners are employed, bolts 50 with square necks 52, mating with thumb nuts 54 with serrated edges 56, may be used.

Figure 17:
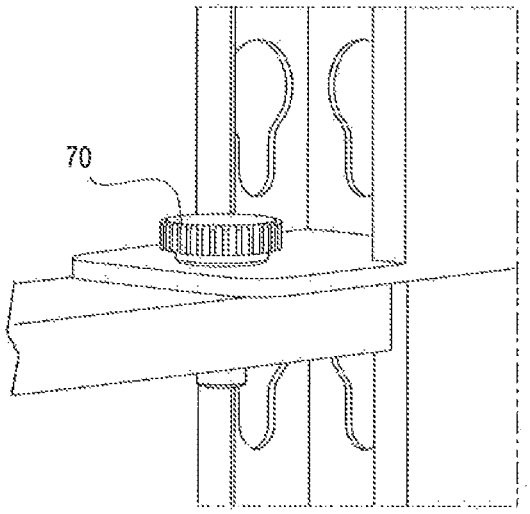
FIGS. 17 and 18 are enlarged partial perspective views, showing a side member unattached (FIG. 17) and attached (FIG. 18, using a thumb screw and inverted flange nut) to two vertically-stacked C-shaped vertical corner posts, in connection with the FIG. 4-type shelving system.
Figure 18:
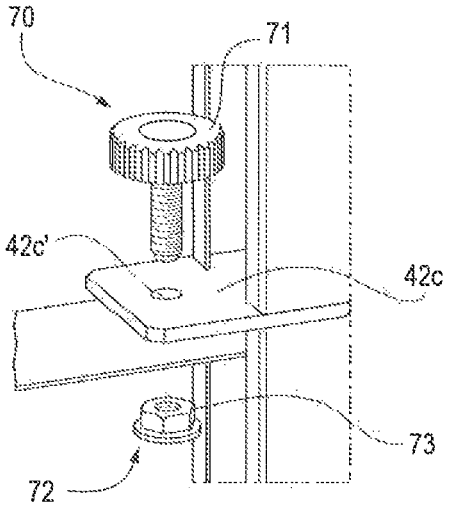
Figure 19A:
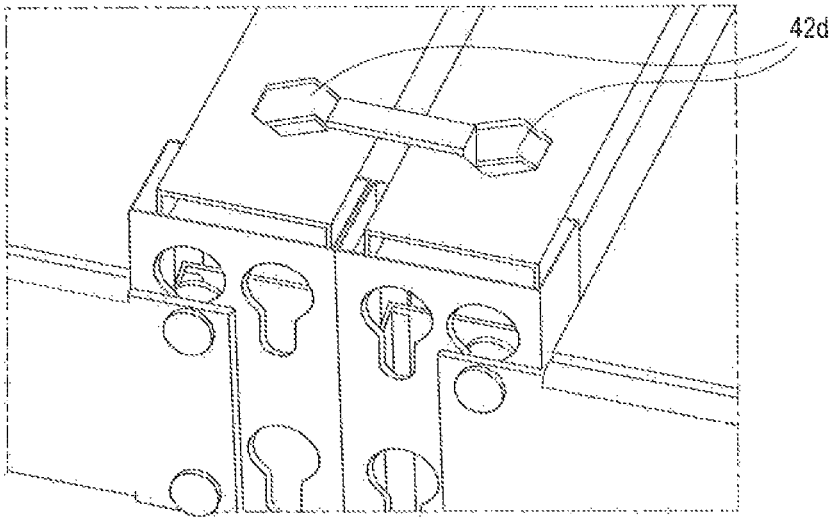
FIG. 19A is an enlarged partial perspective view showing upper edge portions of two FIG. 4-type shelving systems, located side-by-side each other, with adjacent apertures/cutouts located at the top of adjacent C-shaped vertical corner posts.
Figure 19B:
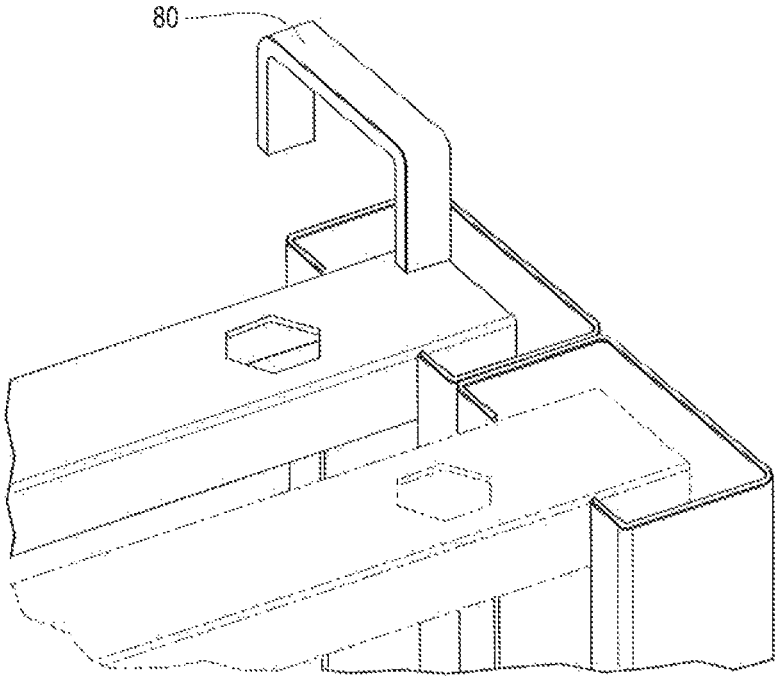
FIG. 19B is a view similar to FIG. 19A, showing a U-shaped connector which may be used to attached the FIG. 4-type shelving systems in side-by-side location to each other.

Referring now to FIGS. 17-18, with the heavy-duty shelving rack 40, for example, intermediate horizontal tubes 43 (i.e., tubes 43 other than the top-most and bottom-most tubes 43) may be connected to vertical posts 42 using thumbscrew 70 with serrated edges 71, which mates with inverted flange nut 72 having hexagon-shaped neck 73. For this purpose, the bottom of posts 42 may include internal extending flange 42*c* with aperture 42*c*', for accepting thumbscrew 70, Referring now to FIGS. 19A-19B, heavy duty shelving racks 40 may be located side-by-side, as shown. For this purpose, large U-shaped connector 80 may be inserted into adjacent apertures/cutouts 42*d* located at the upper ends of posts 42, to retain racks 40 together when placed side-by-side.

Figure 20:
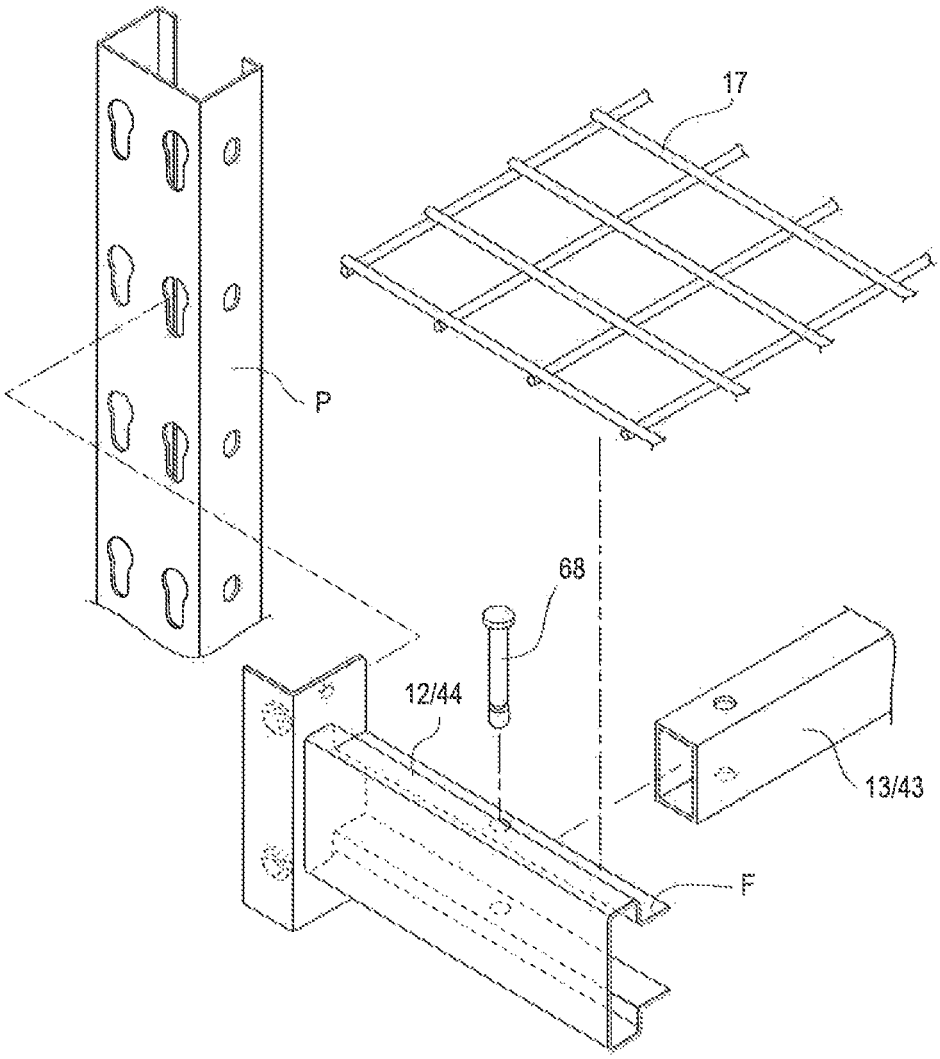
FIG. 20 is an enlarged partial perspective view showing a dropped pin connection useful for attaching side members to cross-members in the shelving assembly examples of FIGS. 1 and 4.

Referring now to FIG. 20 and to U.S. Pat. No. 10,806,257, the "dropped pin" connection shown there (see joint pin 23 shown in FIG. 4 of the '257 patent, and described at 4:30-41) may also be preferably employed in the two shelving rack examples shown in FIGS. 1 and 4. Thus, referring to FIG. 20, dropped pin 68 may be used to connect cross members 12/44 to horizontal tubes 13/43, respectively. Wire shelving 17 may be attached as shown. Flange F on cross-member 12/441 may be attached to post P as shown.

Figure 21:
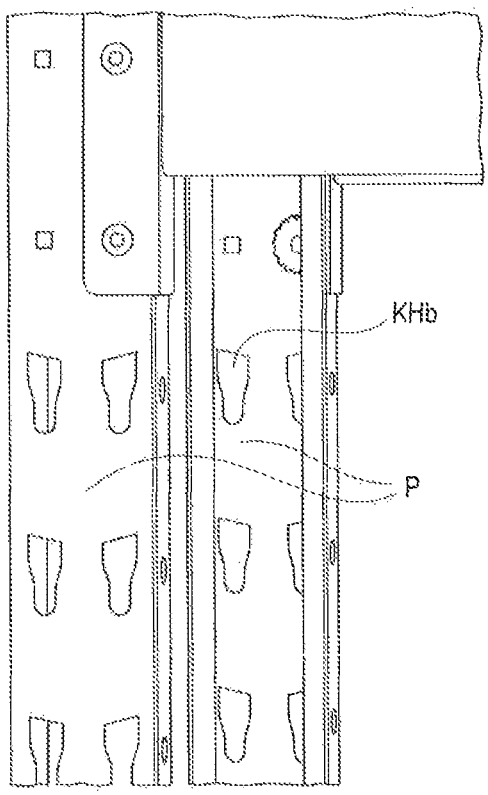
FIGS. 21-22 are enlarged partial planar perspective views of an upper portion of adjacent vertical posts (FIG. 21) or a vertical post (FIG. 22) illustrating different keyhole cutouts that may be used.
Figure 22:
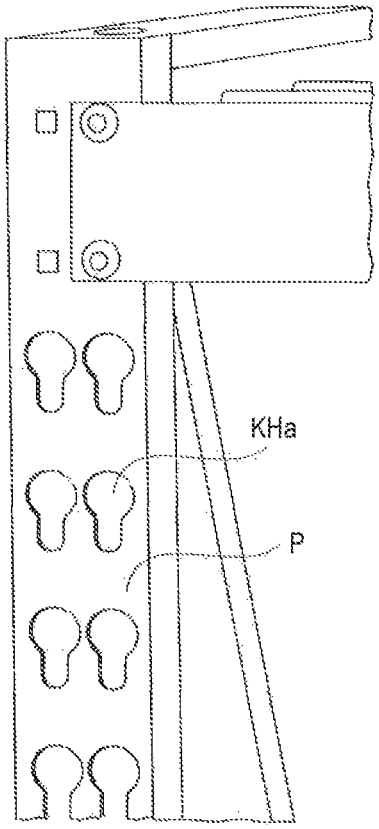

Referring to FIGS. 21-22, to further differentiate the shelving assemblies, vertical posts P carry keyholes with different shapes which may be used, such as keyholes KHa with a curved top portion and keyholes KHb with a flat top portion. With either keyhole, similar-shaped rivets may be used for engagement.

The above description is not intended to limit the meaning of the words used in the following claims that define the invention. Persons of ordinary skill in the art will understand that a variety of other designs still falling within the scope of the following claims may be envisioned and used. It is contemplated that these additional examples, as well as future modifications in structure, function, or result to that disclosed here, will exist that are not substantial changes to what is claimed here, and that all such insubstantial changes in what is claimed are intended to be covered by the claims.

We claim:

1. A shelving assembly, comprising:

first and second side frame structures, each comprising a pair of adjacent vertical posts connected by three or more horizontal end members, including top-most and bottom-most horizontal end members, and wherein the first and second side frame structures are connected to each other by three or more pairs of horizontal cross-members, including top-most and bottom-most pairs of horizontal cross-members;

wherein the top-most and bottom-most horizontal end members are welded to the vertical posts;

one or more shelving units located between the top-most and bottom-most pairs of horizontal cross-members, the one or more shelving units connected by snap-fit attachment to the vertical posts;

wherein the top-most and bottom-most pairs of horizontal cross-members are attached by threadable fasteners to the vertical posts; and wherein the horizontal cross-members include a flanged end with punched square apertures, ends of the vertical posts include punched square apertures, and each of the punched square apertures accommodates bolts with square necks; and wherein the shelving assembly is capable of being relatively rapidly assembled.

2. The shelving assembly of claim 1, further comprising a tube member weldably and diagonally connected to one of the pairs of adjacent vertical posts.

3. The shelving assembly of claim 1, wherein the bolts are configured to mate with thumb nuts having serrated edges.

4. The shelving assembly of claim 1, wherein ends of the one or more shelving units include stamped rivets or tabs for accommodating apertures on the vertical posts.

5. The shelving assembly of claim 1, wherein keyholes are stamped into substantially an entire length of the vertical posts.

6. The shelving assembly of claim 1, and wherein the vertical posts are C-shaped in cross-section, and wherein a first side of each of the C-shaped vertical posts includes side-by-side keyholes that run substantially an entire length of the vertical posts, and a second side of each of the C-shaped vertical posts, at opposing ends of the posts, includes stamped square apertures.

* * * * *